US009572421B2

(12) United States Patent
Klinke

(10) Patent No.: US 9,572,421 B2
(45) Date of Patent: Feb. 21, 2017

(54) HEIGHT-ADJUSTABLE WORK TABLE

(71) Applicant: LINAK A/S, Nordborg (DK)

(72) Inventor: Norbert Klinke, Augustenborg (DK)

(73) Assignee: Linak A/S, Nordborg (DK)

( * ) Notice: Subject to any disclaimer, the term of this patent is extended or adjusted under 35 U.S.C. 154(b) by 0 days.

(21) Appl. No.: 15/069,421

(22) Filed: Mar. 14, 2016

(65) Prior Publication Data

US 2016/0192773 A1 Jul. 7, 2016

Related U.S. Application Data

(63) Continuation of application No. 14/111,038, filed as application No. PCT/DK2012/000045 on Apr. 16, 2012, now abandoned.

(30) Foreign Application Priority Data

Apr. 14, 2011 (DK) ..... 2011 00300

(51) Int. Cl.
*A47B 9/00* (2006.01)
*A47B 9/04* (2006.01)
(Continued)

(52) U.S. Cl.
CPC . *A47B 9/04* (2013.01); *A47B 9/20* (2013.01); *A47B 51/00* (2013.01); *A47B 77/022* (2013.01); *A47B 91/005* (2013.01); *A47B 91/028* (2013.01); *A47B 95/002* (2013.01); *A47B 2009/046* (2013.01); *A47B 2095/004* (2013.01)

(58) Field of Classification Search
CPC ... A47B 51/00; A47B 2220/0013; A47B 9/04; A47B 9/043; A47B 9/046; A47B 17/02; A47B 21/02; A47B 77/022; A47B 91/005; A47B 91/028; A47B 95/002; A47B 9/20; A47B 2095/004; A47B 2009/046
See application file for complete search history.

(56) References Cited

U.S. PATENT DOCUMENTS 5,088,421 A * 2/1992 Beckstead ..... A47B 9/12 108/147
5,161,868 A * 11/1992 Hooser ..... A47B 19/06 312/223.4
(Continued)

FOREIGN PATENT DOCUMENTS

DE 3132171 A1 * 3/1983 ..... A47B 51/00
DE 9409755 9/1994
(Continued)

*Primary Examiner* — Hanh V Tran
(74) *Attorney, Agent, or Firm* — Dykema Gossett PLLC

(57) ABSTRACT

Height-adjustable work table, preferably kitchen table comprising at least one cabinet on top of which a table top is located. The cabinet(s) is located on a number of electrically driven height-adjustable platforms. In that the platforms are mutually retained by at least one connection rail these appear as stable both during the assembly of the work table and of the assembled table. Between a surface, typically a floor on which the platform is located, and an underside of the cabinet a toe kick is placed. This toe kick is telescopic in height such that the toe kick regardless of the adjusted height of the kitchen table shuts off access under the cabinet. The connection rail may constitute an element of the telescopic toe kick.

18 Claims, 7 Drawing Sheets

(51) Int. Cl.

| | |
|---|---|
| ***A47B 91/00*** | (2006.01) |
| ***A47B 91/02*** | (2006.01) |
| ***A47B 95/00*** | (2006.01) |
| ***A47B 51/00*** | (2006.01) |
| ***A47B 77/02*** | (2006.01) |
| ***A47B 9/20*** | (2006.01) |

(56) References Cited

U.S. PATENT DOCUMENTS

| | | | | |
|---|---|---|---|---|
| 5,909,933 | A * | 6/1999 | Keene | A47B 9/10 312/140.1 |
| 5,937,699 | A * | 8/1999 | Garrec | B25J 18/025 74/89.35 |
| 6,213,575 | B1 * | 4/2001 | Brin, Jr. | A47B 77/04 108/147 |
| 6,877,825 | B2 * | 4/2005 | Khosropour | A47B 51/00 312/140.1 |
| 6,997,116 | B2 * | 2/2006 | George | A47B 9/00 108/147 |
| 8,960,825 | B2 * | 2/2015 | Kwon | F25D 23/04 108/106 |
| 2006/0201301 | A1 * | 9/2006 | Schwaiger | B23D 45/068 83/477.1 |
| 2009/0212479 | A1 * | 8/2009 | Yu | B23Q 1/0054 269/309 |
| 2012/0280604 | A1 * | 11/2012 | Randlov | A47B 51/00 312/312 |

FOREIGN PATENT DOCUMENTS

| | | | |
|---|---|---|---|
| DE | 20008959 | | 10/2001 |
| DE | 202004012049 | U1 * | 1/2006 |
| DE | 102011009656 | | 8/2012 |
| GB | 1461033 | | 1/1977 |
| GB | 2297803 | | 8/1996 |
| JP | 2003159122 | A * | 6/2003 |

* cited by examiner

HEIGHT-ADJUSTABLE WORK TABLE

CROSS-REFERENCE TO RELATED APPLICATIONS

This application is a continuation of application Ser. No. 14/111,038, filed Oct. 10, 2013 (now abandoned), which was a U.S. national stage filing of PCT/DK2012/000045, filed 16 Apr. 2012.

BACKGROUND OF THE INVENTION

Field of the Invention

The present invention relates to a height-adjustable work table, preferably a kitchen table comprising at least one cabinet having a table top thereon, and where the cabinet(s) is/are placed on a number of height-adjustable platforms.

The Prior Art

As an example of such a height-adjustable work table reference can be made to WO 2011/069509 A2 Linak A/S. One of the problems concerning the assembly of the height-adjustable platforms is to get them lined up so that they both are horizontal and stand in a straight line as well as are located with the desired mutual distance. This also applies during the further assembly work of the work table where the platforms are easily pushed out of their position, out of level or out of the row. Another issue relating to such height-adjustable work tables is to be able to shut off access under the cabinets regardless of the height to which the work table is adjusted.

The purpose of the invention is to provide a solution to the outlined problems.

SUMMARY OF THE INVENTION

This is achieved according to the invention in that the platforms are mutually fixed by means of at least one connection rail. It is thus ensured that the platforms during the further assembly of the work table is retained in the mounted position.

The platforms comprise a housing with a spindle nut at each end, the spindle units being driven by an electric motor through a gear train, a belt drive or a chain. It is thus possible to design the platforms with such a low height that they do not constitute a limitation of the minimum height of the work table. The platforms may further be designed with a base area consisting with the base area of the cabinets. In an attractive embodiment the platforms are designed as slim, longitudinal units. In case the work table comprises a row of cabinets, the platforms are placed such that they support two adjacent cabinets. If the cabinets are exceptionally wide, one or more platforms may naturally be placed under the middle of the cabinet. At the ends of the row of cabinets the platform is naturally placed within the side of the cabinet, such that the platform does not protrude outside of the cabinet. For a stable and horizontal support of the work table, it is essential that the height-adjustable platform(s) can be adjusted so that they are horizontal regardless of unevenness and slanting of the floor. When using more platforms, it is also important that these are placed correctly, i.e., that they provide an appropriate support for the cabinets.

In order to level the platforms these may be equipped with an adjusting screw in each corner for compensating for unevenness and slanting of the floor. In another embodiment the spindle unit is with a lower end mounted on a plate resting on the floor and where there on the upper end of the spindle unit is also furnished with a plate on which the cabinets are arranged. The plates will per se to a certain extent compensate for unevenness.

In an expedient embodiment the connection rail is arranged in front of the platforms, which eases the access for mounting the connection rail. It is understood that the connection rail may consist of more sections, placed end to end in case of a long row of cabinets. In a further embodiment a connection rail is provided both at the front and rear of the platforms. This increases the stability of the connection of the platforms.

For mounting the connection rail the front side of the platform housing is in an embodiment provided with at least one longitudinal groove, and the connection rail has at least one flap which can be pressed into the groove in the platforms. This ensures an easy and secure mounting of the connection rail and where the horizontal flap keeps the platforms level while the vertical part of the connection rail ensures that the platforms are in a straight line. In a further embodiment the front of the platform housing is furnished with two longitudinal grooves and the connection rail has two flaps which can be pressed into the respective grooves in the platforms. In a further embodiment the connection rail has a U-shaped cross section, where the flaps are equipped with snap-locking means so that they may be snapped fixedly around a protruding portion of the platform housing intended for that purpose. Thus the connection rail may be mounted without use of tools.

In order to shut off access under the work table, it can be equipped with a toe kick, which according to the invention is telescopic in height. It is thus possible to design the toe kick such that it can adjust to the actually adjusted height of the work table such that access under the work table is shut off. The toe kick can consist of two or more mutually telescopic elements. According to an attractive embodiment the toe kick consists of three mutually telescopic elements which can cover a large span of the adjustment height and further provides a low initial height.

In an embodiment at least one element of the toe kick is secured to the height-adjustable platforms. In an expedient embodiment an intermediate telescopic element of the toe kick is secured to the height-adjustable platforms.

In a specific embodiment the connection rail has a groove while the intermediate element of the toe kick has a folded flap which can be pressed into the groove in the connection rail for retaining it. In a further embodiment the connection rail is designed such that it further constitutes an intermediate element of the toe kick. In a further embodiment the lowermost telescopic element is likewise secured to the height-adjustable platforms. Thus, a troublesome securing to the floor is avoided, where a heating coil is typically installed, making it problematic to screw the telescopic element onto the floor due to the risk of damaging the heating coil. It is likewise expedient to secure the topmost element to the height-adjustable platforms as it may also be difficult to secure this to the cabinets since it should be done after the cabinets have been placed on the platforms.

The securing of elements of the toe kick to the platforms and the connection rail, respectively also contributes to a stabilization of the work table both during the assembly and of the assembled work table.

Embodiments of the invention will be described more fully with reference to the accompanying drawings.

DETAILED DESCRIPTION OF THE DRAWINGS

Figure 1:
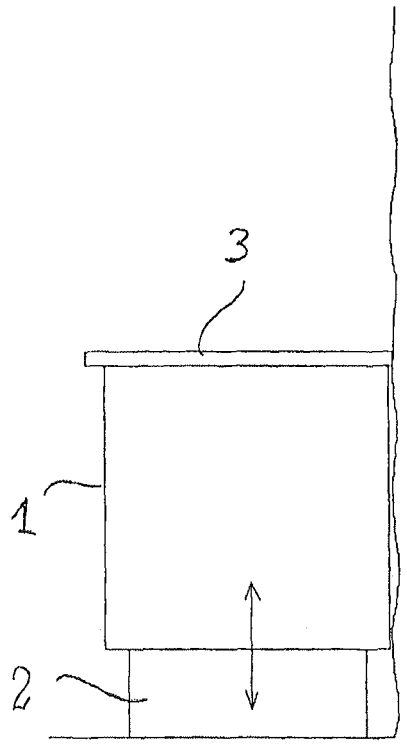
FIG. 1 shows a schematic view of a work table in the form of the kitchen table shown from the end.

FIG. 1 shows a schematic view of a work table in the form of a kitchen table placed against a wall. The work table consists of a number of base cabinets 1 placed on top of a number of height-adjustable platforms 2. On top of the cabinets 1 is mounted a table top 3.

Figure 2:
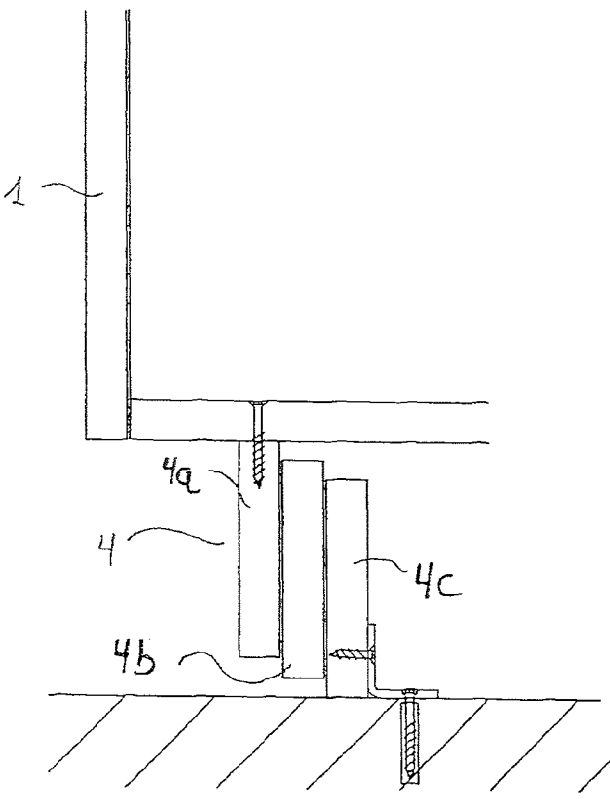
FIG. 2 shows a section at the bottom of the front side of the kitchen table with a first embodiment of a toe kick.

FIG. 2 shows a schematic view of a section at the bottom of the front side of the kitchen table, where under the cabinets 1 at a short distance from the front side is mounted a toe kick 4 which is telescopic in height. The toe kick 4 comprises three elements, i.e., a topmost element 4*a*, an intermediate element 4*b* and a lowermost element 4*c*. The elements 4*a-c* are in the form of planks, where the topmost element 4*a* is secured to the underside of the cabinets by means of screws while the intermediate member 4*b* is secured to the height-adjustable platforms, not shown in the figure, while the lowermost element 4*c* is secured to the floor by means of angle brackets and screws.

Figure 4:
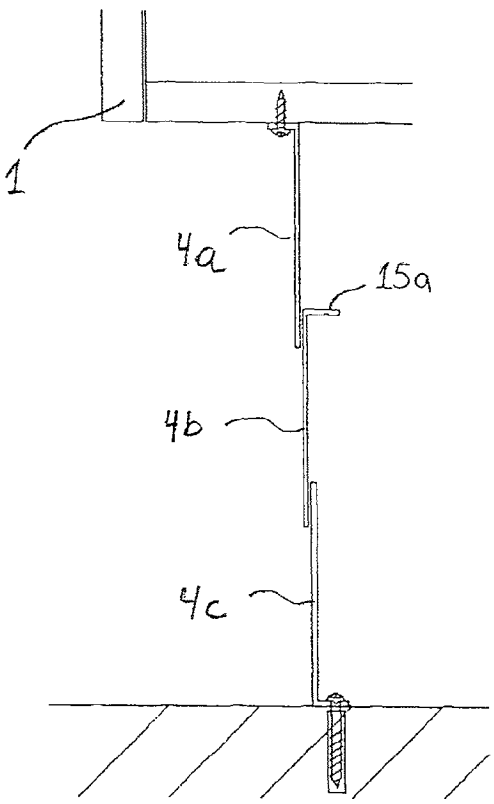
FIGS. 3 and 4 show another embodiment of the toe kick.
Figure 3:
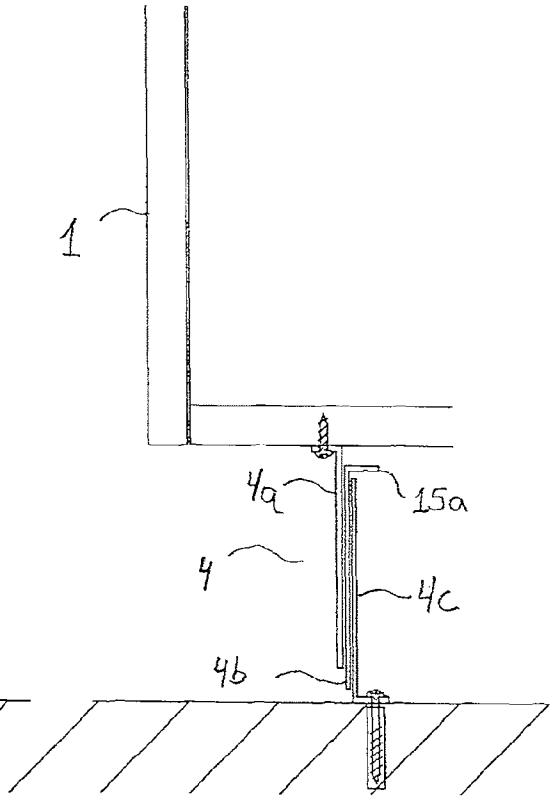

FIGS. 3-4 show a corresponding embodiment where the elements of the toe kick are made from metal profiles.

Figure 5:
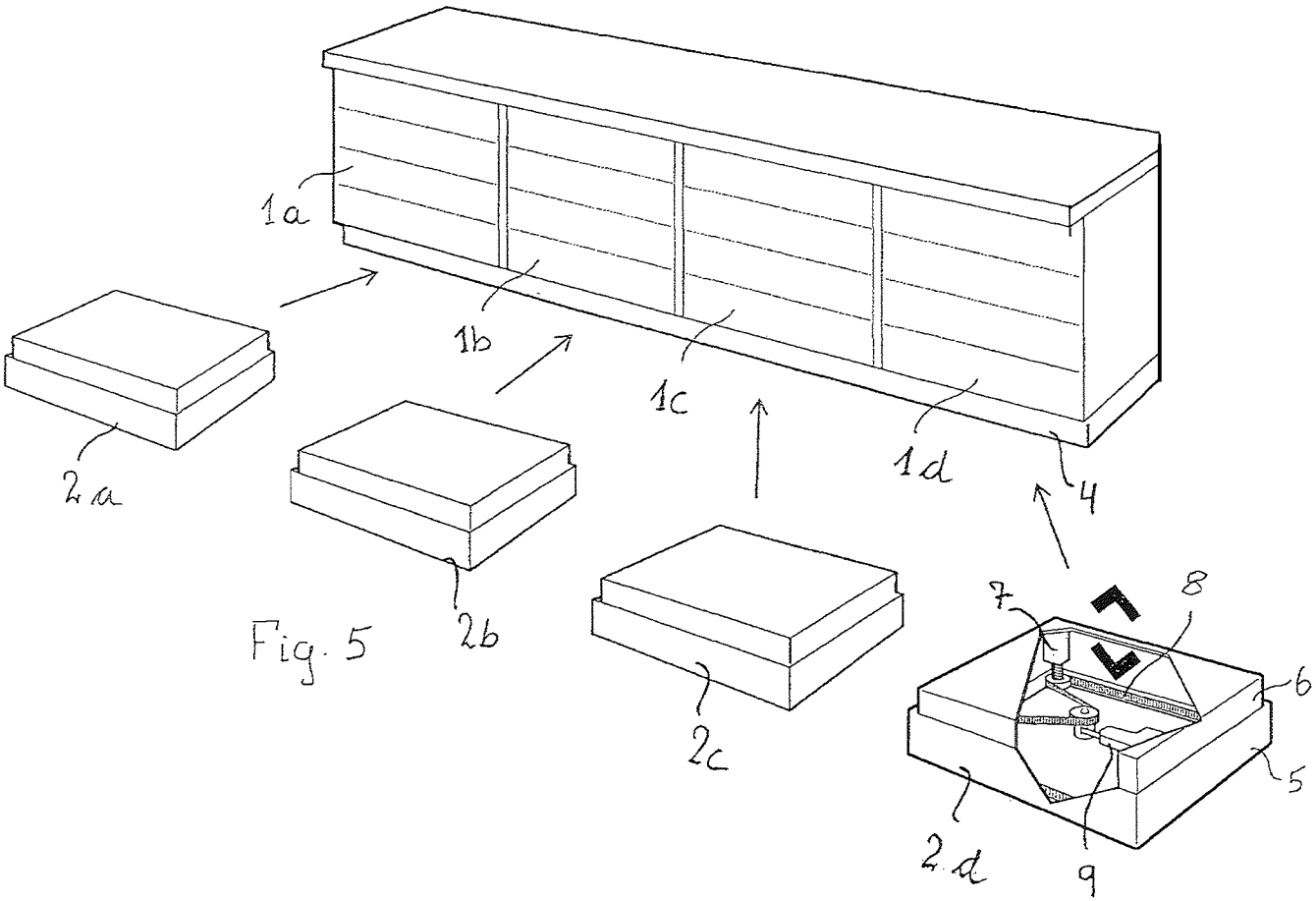
FIG. 5 shows a work table comprising four cabinets.

FIG. 5 shows a work table comprising four cabinets 1*a*-1*d* arranged on top of a height-adjustable platform 2*a*-2*d* each. On top of the cabinets is mounted a table top 3, while under the cabinets 1*a*-1*d* and in front of the platforms 2*a*-2*d* is mounted a telescopic toe kick 4. The platforms comprise two telescopic box-shaped units 5,6 arranged inside each other. At each corner is mounted a spindle unit 7 driven through a toothed belt 8 by a centrally located electric motor 9.

Figure 6:
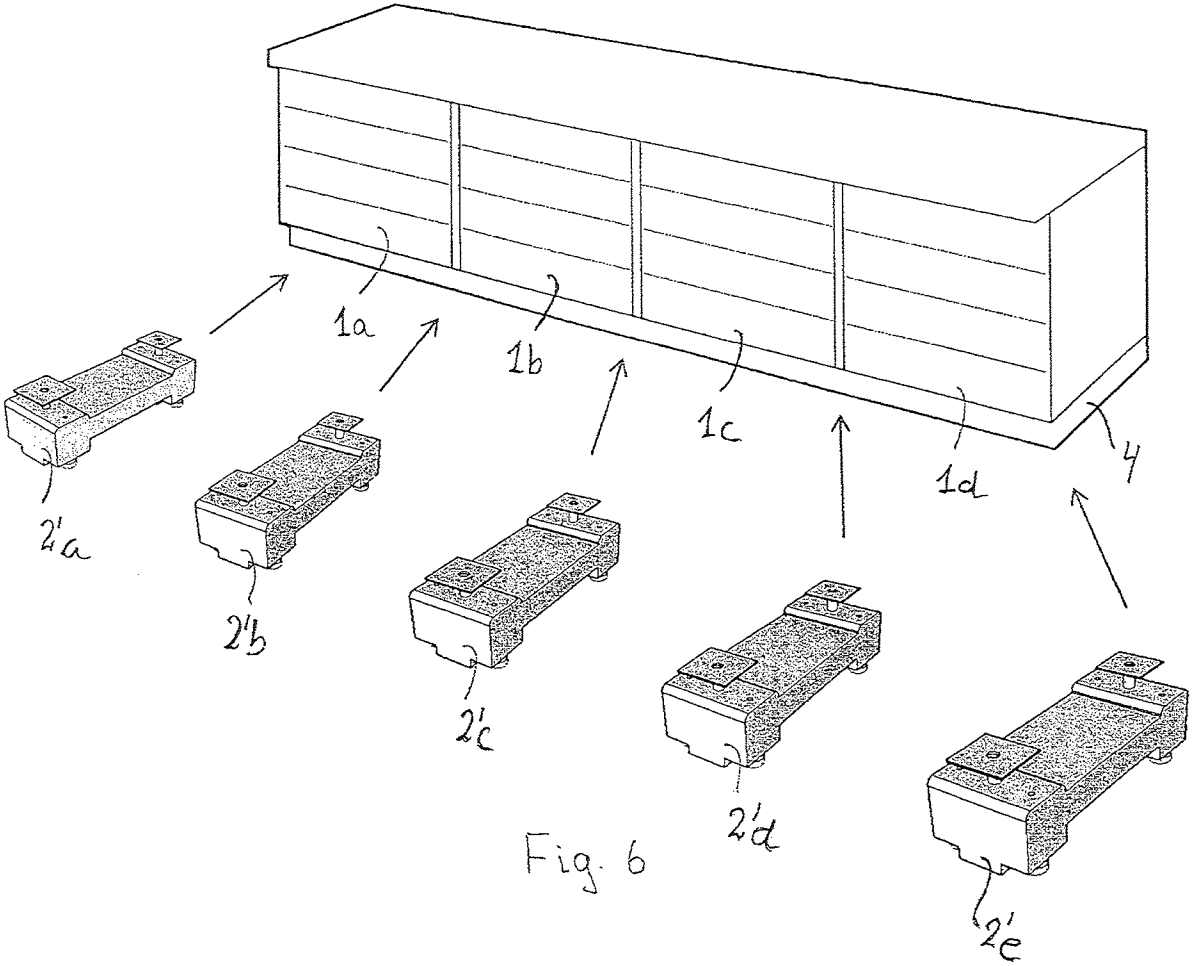
FIG. 6 shows a slightly different embodiment than shown in FIG. 5, as the platforms here are narrow.

FIG. 6 shows a slightly different embodiment where the platforms 2'*a*-2'*e* are narrow, where a platform 2'*a*, 2'*e* is arranged at each end and otherwise distributed between these. In case of individual joined cabinets 1*a*-1*d*, the platforms 2'*b*-2'*d* are expediently placed where the cabinets meet.

Figure 7:
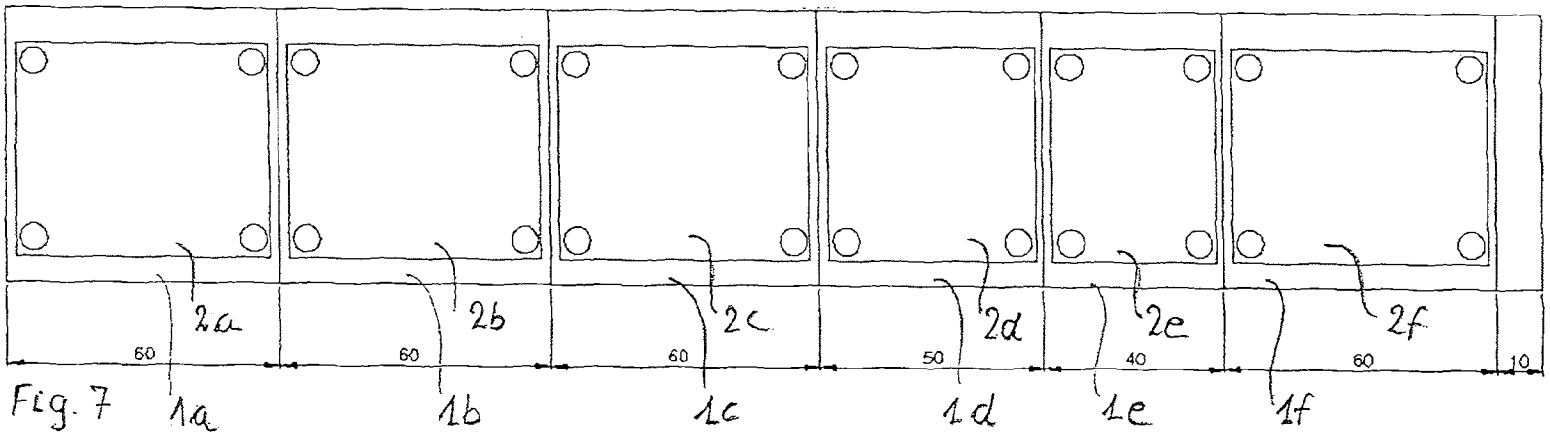
FIG. 7 shows a layout, where the platforms have the same width or approximately the same width as the cabinets.
Figure 8:
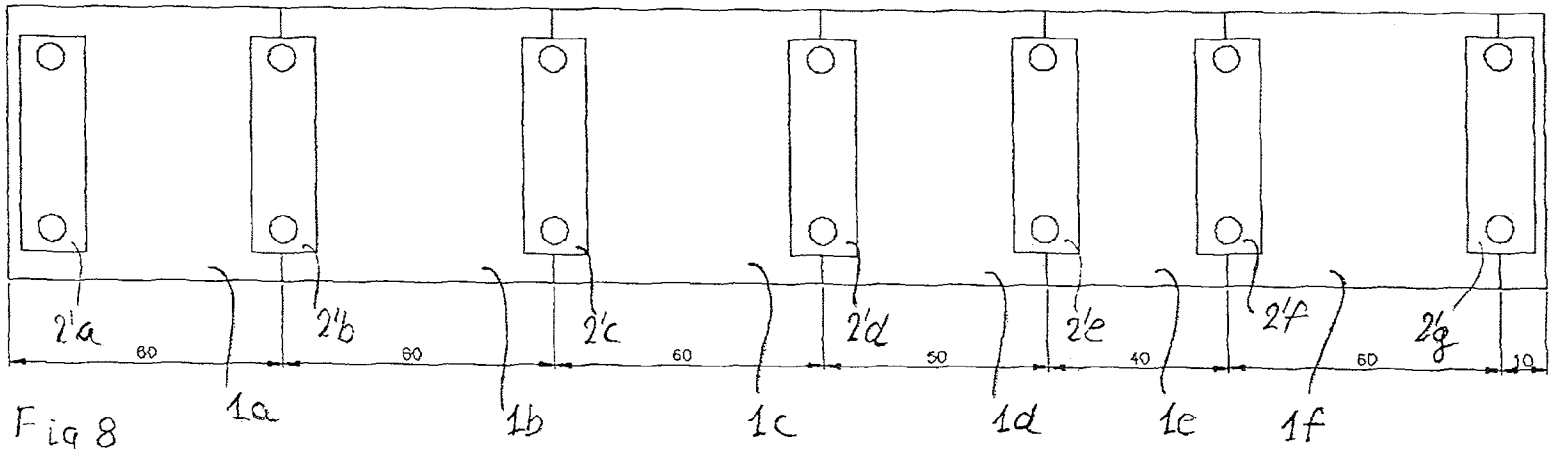
FIG. 8 shows a layout, where the platforms are narrow.

FIGS. 7 and 8 show a layout of the placement of the platforms. The layout shown in FIG. 7 relates to the embodiment shown in FIG. 5, where the platforms 2*a*-2*d* are of the same or approximately the same width as the cabinets 1*a*-1*d*. The other layout, shown in FIG. 8 relates to the embodiment shown in FIG. 6, where the platforms 2'*a*-2'*e* are narrow. The layouts further illustrate that there with the invention may be used cabinets with different widths. The difference between the embodiments shown in FIGS. 7 and 8 is that the platforms in the embodiment shown in FIG. 7 have individual widths adapted to the individual cabinets while platforms of the same width may be used in the embodiment shown in FIG. 8, i.e. the platforms may be standardized to one width.

Figure 9:
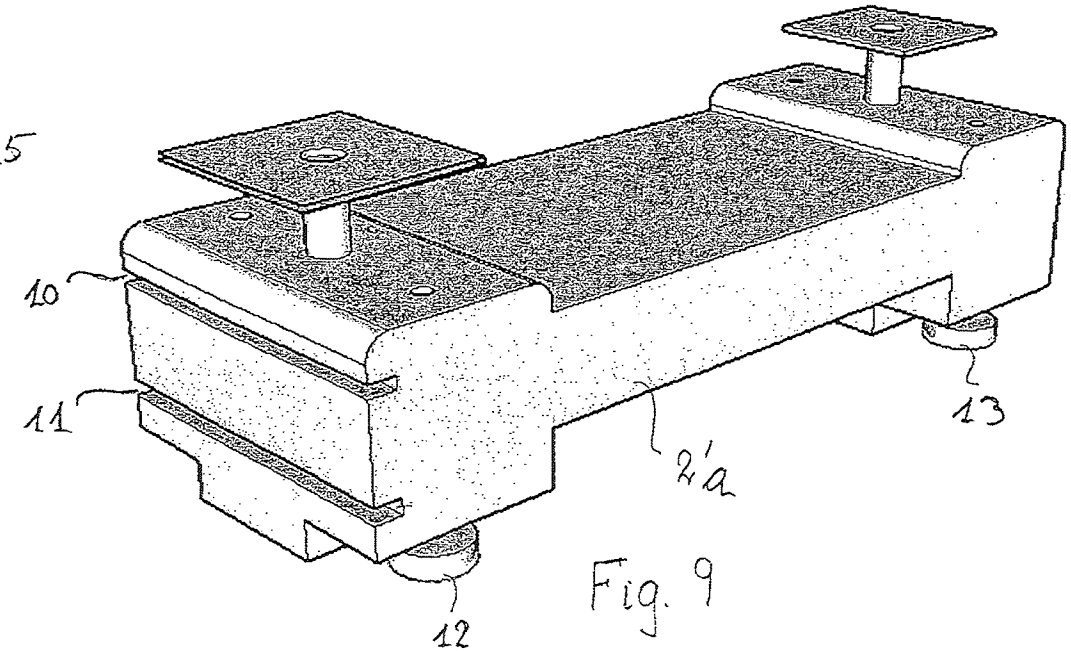
FIG. 9 shows an embodiment of a narrow platform.
Figure 10:
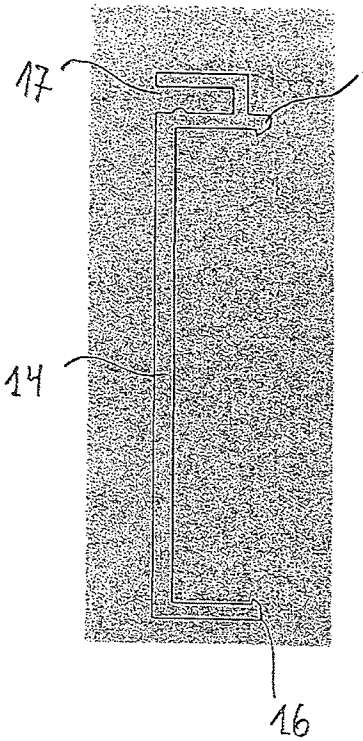
FIG. 10 shows a cross section of the intermediate element of a toe kick, alternatively a connection rail for the platforms.

In FIG. 9 is shown a narrow platform 2'*a*, where it can be seen that the front side of the platform is equipped with two longitudinal grooves 10, 11. The platforms are equipped with an adjusting screw 12,13 in each corner in order to be able to compensate for unevenness and slanting of the floor so that the platforms may be leveled. The platforms may be connected by means of a connection rail 14 as shown in FIG. 10, such that the platforms will be mutually locked, which eases the assembly work. The connection rail 14 has two flaps 15 and 16, which are pressed into the grooves 10, 11 in the platforms. The connection rail can per se constitute the intermediate element of the toe kick. Alternatively, the intermediate element of the toe kick may be secured to the connection rail 14 cf. FIGS. 3 and 4. The intermediate element 4*b* of the toe kick can with a folded flap 15*a* be pressed into a groove 17 on the connection rail.

Figure 11:
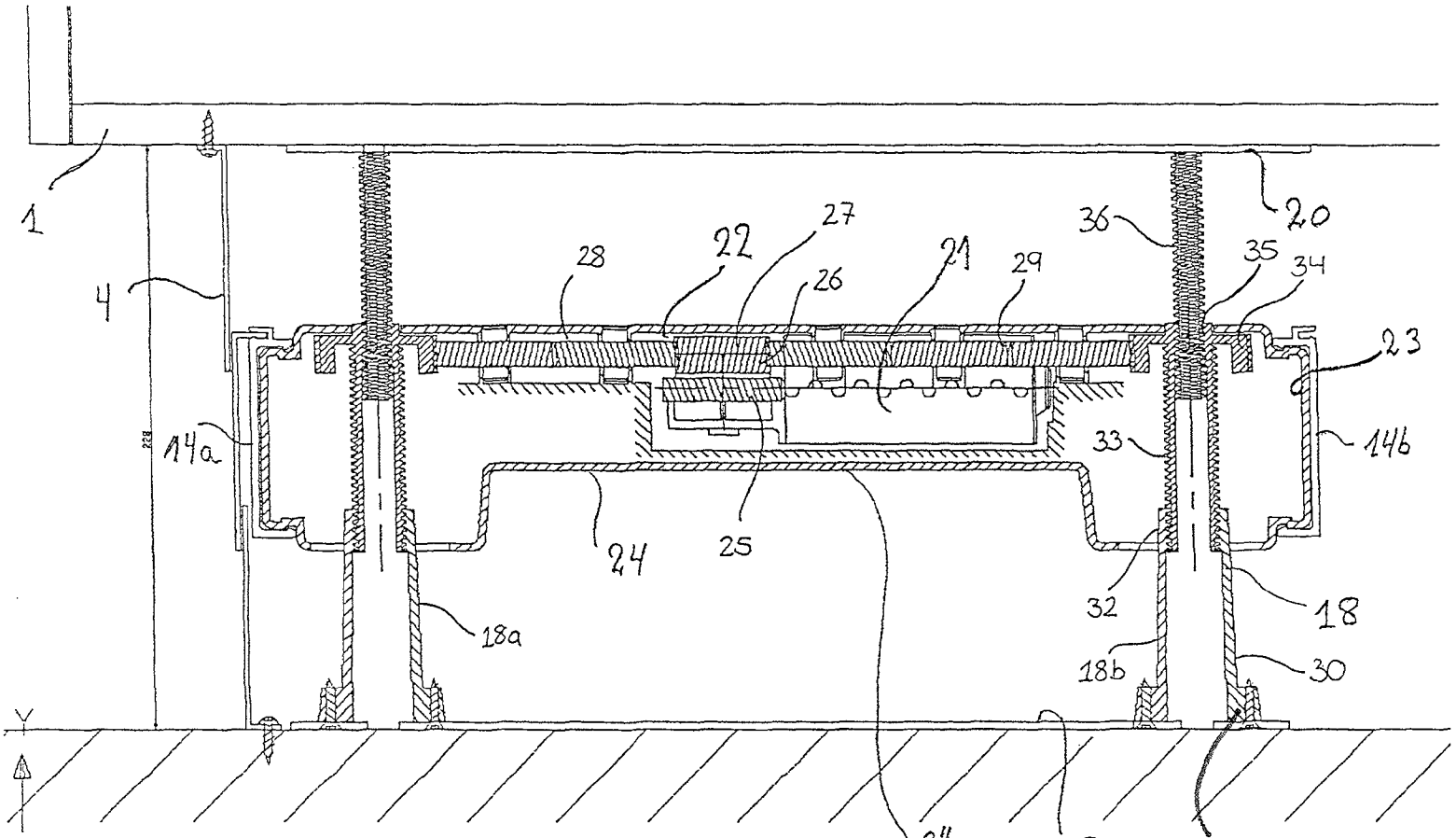
FIG. 11 shows a cross section through an embodiment of a platform.

FIG. 11 shows a cross section through an embodiment of a platform 2". This comprises a housing with a spindle unit 18 at each end. The spindle unit 18 is with its lower end mounted to a plate 19 resting on the floor. The upper end of the spindle unit 18 is likewise furnished with a plate 20 on which the cabinets 1 are arranged. The spindle units 18 are driven by an electric motor 21 through a gear train 22, where the motor comprises a worm gear 25. Two gear wheels 26,27 are secured to the worm gear, which drives the gear wheels 28 to the spindle unit 18*a* to the left in the drawing and the gear wheels 29 which drives the spindle unit 18*b* to the right in the drawing, respectively. Alternatively, the spindle units 18 may be driven through a toothed belt or a chain. The spindle units 18 comprise a tube section 30 which at the bottom is equipped with a foot 31 for securing to the plate 19 and at the top has a spindle nut 32. The spindle units 18 further comprise a tubular spindle 33 with external thread which cooperates with the spindle nut 32 in the tube section 30. At the top of the tubular spindle 33 a gear wheel 34 is mounted, which meshes with the gear train 29 from the motor. The top of the tubular spindle 33 is furnished with a spindle nut 35. Finally, there is a massive spindle 36 with external thread which cooperates with the spindle nut 35 in the tubular spindle 33. The upper end of the massive spindle 36 is fixed to the plate piece 20 on which the cabinet 1 rests. When the motor is started up, the hollow spindle 33 is rotated through the worm gear 25 and the gear train 29. The hollow spindle will thus screw itself up the fixed tube section 30 while the hollow spindle 33 screws itself down the massive spindle 36 corresponding to that the massive spindle is elevated. Thereby, the cabinet 1 is lifted. The two spindle units 18*a*, 18*b* run synchronously due to the gear trains 28,29.

Both at the front and rear the individual platforms 2" are mutually connected by means of connection rails 14'*a* and 14'*b*. Unlike the embodiment in FIGS. 9 and 10, the connection rails here have a U-shaped cross section, the legs have snap-locking means so that they may be snapped fixedly around a protruding portion 23 of the platform housing 24 intended for that purpose. Otherwise a toe kick 4 is mounted in front of the platforms as shown above in FIGS. 3-4.

The invention thus provides a solution for a stable and horizontal support of the work table both during the assembly work and of the assembled table. It is essential that the height-adjustable platforms can be adjusted, such that they are level despite unevenness and slanting of the floor. When using more platforms it is also important that these are placed correctly i.e. that they provide an appropriate support for the cabinets.

The invention claimed is:

1. A height-adjustable platform for a work table, the platform comprising:

a housing;

a spindle unit at each end of the housing, each spindle unit comprising a tube section with a first spindle nut at a top and a foot at a bottom thereof;

a tubular spindle with external thread which cooperates with the first spindle nut in the tube section;

a first gear wheel at the top of the tubular spindle;

a second spindle nut arranged at a top of the tubular spindle;

a solid spindle with external thread which cooperates with the second spindle nut in the tubular spindle;

an electric motor with a worm gear comprising a worm and a worm wheel; and a gear train driven by the electric motor through the worm gear, the gear train being in mesh with the gear wheel of the respective spindle unit for extending and retracting the respective spindle unit.

2. The height-adjustable platform according to claim 1, including an upper plate element fixed to upper ends of the solid spindles.

3. The height adjustable platform according to claim 1, including at least one adjusting screw for leveling the housing.

4. The height-adjustable platform according to claim 1, including a lower plate element beneath the spindle units.

5. A platform assembly for a work table comprising a plurality of height-adjustable platforms according to claim 1 positioned in a row, and including a connection rail which extends along a front of the row of platforms.

6. The platform assembly according to claim 5, including a connection rail which extends along a rear of the row of platforms for interconnecting the platforms.

7. The platform assembly according to claim 5, wherein a front side of each housing has a longitudinal groove and the connection rail has at least one flap which can be pressed into the groove in each of the housings.

8. The platform assembly according to claim 7, wherein the connection rail has a U-shaped cross section with flaps that are equipped with snap-locking means such that they may be snapped fixedly around a protruding portion of each of the housings.

9. The platform assembly according to claim 5, including a toe kick which is telescopic in height attached to an end of the housings.

10. The platform assembly according to claim 9, wherein the toe kick comprises three mutually telescopic elements.

11. The platform assembly according to claim 10, wherein one element of the toe kick is secured to each of the housings.

12. The platform assembly according to claim 10, wherein an intermediate telescopic element of the toe kick is secured to each of the housings.

13. The platform assembly according to claim 10, wherein the connection rail has a groove and the intermediate element of the toe kick for securing to the connection rail is equipped with a folded flap which can be pressed into the groove in the connection rail.

14. The platform assembly according to claim 10, wherein the connection rail further constitutes an intermediate element of the toe kick.

15. The platform assembly according to claim 9, wherein a lowermost telescopic element of the telescopic toe kick likewise is secured to the housings.

16. The platform assembly according to claim 9, wherein a topmost telescopic element of the telescopic toe kick likewise is secured to the housings.

17. The height-adjustable platform according to claim 1, wherein the motor is located in a horizontal position in the housing between the two spindle units.

18. The height-adjustable platform according to claim 1, wherein the gear train includes a second gear wheel which is connected to the worm wheel and extends to the first gear wheel of a first spindle unit, and a third gear wheel which is connected to the worm wheel and extends to the first ear wheel of a second spindle unit.

* * * * *